US005838219A

United States Patent [19]

Du et al.

[11] Patent Number: 5,838,219

[45] Date of Patent: Nov. 17, 1998

[54] ELECTRICAL CIRCUIT BREAKER WITH MANUAL AND REMOTE ACTUATORS

[75] Inventors: Kebo Du, Delmar; Stefan Gabrielson, Rehoboth Beach, both of Del.

[73] Assignee: Eaton Corporation, Cleveland, Ohio

[21] Appl. No.: 864,997

[22] Filed: May 29, 1997

[51] Int. Cl.[6] ..... H01H 75/00

[52] U.S. Cl. ..... 335/14; 335/20; 335/68; 200/50.32

[58] Field of Search ..... 335/14, 20, 68, 335/69, 71, 72, 76; 200/51 R, 50.32, 5 B

[56] References Cited

U.S. PATENT DOCUMENTS

| | | | |
|---|---|---|---|
| 2,264,990 | 12/1941 | Lindstrom et al. | 335/70 |
| 3,198,908 | 8/1965 | Staak | 335/68 |
| 4,167,716 | 9/1979 | Horn | 335/14 |
| 4,990,873 | 2/1991 | Granert et al. | 335/68 |
| 5,083,103 | 1/1992 | Winter et al. | 335/14 |

*Primary Examiner*—Lincoln Donovan
*Attorney, Agent, or Firm*—Quarles & Brady

[57] ABSTRACT

An electricity switching device has an control handle reciprocally moveable between two positions. A remotely controllable operator attaches to the switching device and has an actuator that is coupled by a lever to the control handle enabling for manual operation of the device. A motor drives a threaded shaft on which a driver in mounted. Rotation of the threaded shaft by the motor causes the driver to slide within the operator. A handle actuator is coupled to slide with the driver and pushes the control handle between the two positions. Once the handle actuator has been pushed into one of the two positions, the handle actuator moves over the other side of the control handle in order to push in the opposite direction. Movement to the other side also eliminates the handle actuator from interfering with manual operation of the electricity switching device.

20 Claims, 3 Drawing Sheets

ELECTRICAL CIRCUIT BREAKER WITH MANUAL AND REMOTE ACTUATORS

BACKGROUND OF THE INVENTION

The present invention relates to electrical circuit breakers, and more particularly to electrical circuit breakers which can be operated by a remotely controlled actuator.

Circuit breakers are well known devices for preventing over current in electrical circuits. These devices are typically mounted in an electrical panel with the supply buses and individual circuit wires located behind a cover. Each circuit breaker has a lever or handle which extends through an opening in the cover for access by personnel in order to reset the circuit breaker upon being tripped by an over current condition. The lever also may be operated manually to turn off a circuit, for maintenance for example, and then turn it on again.

It is often desirable to be able to operate the circuit breaker without having to physically go to the panel and manually operate the handle. In response, various types of electrically controlled actuators and motor operators have been devised for remote controlled activation. A signal is sent from a remote location to cause the actuator to operate the handle, operating or resetting the circuit breaker.

However, there are times when it is desired to be able to manually operate or reset a remotely operable circuit breaker. Previously, a person had to first disengage the remote controlled actuator in order to manually operate the circuit breaker. This not only required additional steps, but often necessitated that the person reactivate the remote controlled actuator upon completing manual operation. Failure to do so, left the circuit breaker in a state where remote operation could not be performed, a state which was not indicated to a remote operating location.

SUMMARY OF THE INVENTION

A general object of the present invention is to provide an actuator for a circuit breaker which can be remotely controlled and still enable manual operation of the circuit breaker.

Another object is to allow manual operation of the circuit breaker without having to disconnect the remote control actuator or subsequently reconnect that actuator.

A further object of the present invention is to provide manual operator which does not affect subsequent remote control of the circuit breaker.

Yet another object is to provide a manual operator for the circuit breaker which resembles the operator lever on a conventional non-remotely operated circuit breaker.

These and other objects are satisfied by a remotely controllable operator that comprises a housing which attaches to an electricity switching device. The remotely controllable operator includes an electrically powered actuator which is operably connected to reciprocally move a driver within the housing. A handle actuator is connected to the driver and engages the operator handle to effect movement thereof between the two positions. The handle actuator is moveable with respect to the driver so that upon moving the operator handle into one of the two positions, the handle actuator moves from one side of the operator handle to another side.

By moving to the other side of the operator handle, the handle actuator is located to push in the opposite direction toward the other of the two positions. This movement to the other side of the operator handle also eliminates the handle actuator from interfering with manual movement of the operator handle to the other position and with trip operation movement of the handle.

DETAILED DESCRIPTION OF THE INVENTION

Figure 1:
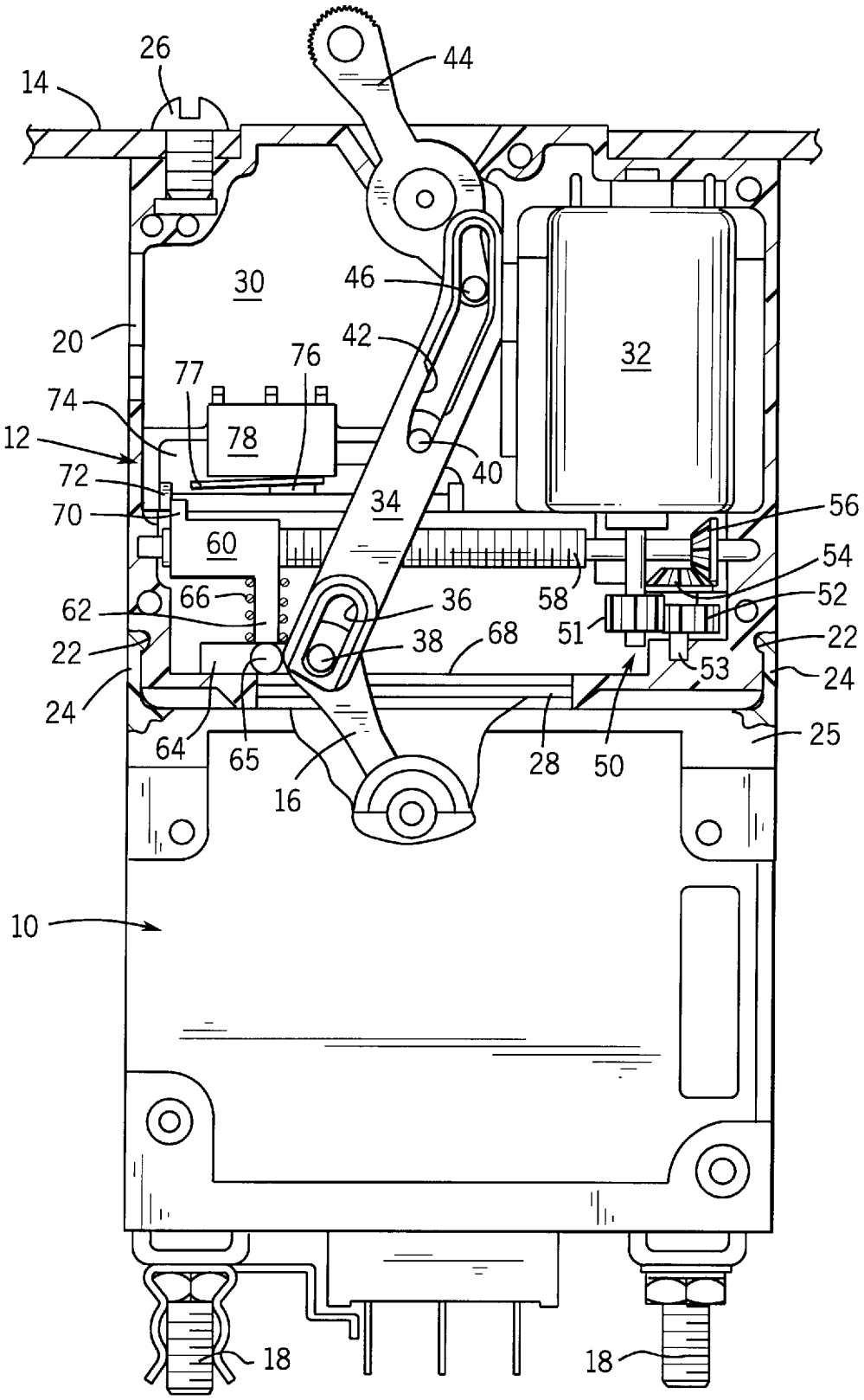
FIG. 1 is a side view of a circuit breaker in the "on" position with the front side attached to a remote operator that has part of an outer casing removed for viewing.

With initial reference to FIG. 1, a conventional circuit breaker 10 is connected to a remote operator 12 both of which are mounted on an electrical panel 14. The circuit breaker 10 also includes electrical terminals 18 for connection to the circuitry that is being controlled. A control handle 16 projects from the circuit breaker housing and can be rotated between "on" and "off" positions thereby closing and opening internal contacts to complete and interrupt an electrical connection between the terminals 18. One skilled in the art will appreciate from the following description that other types of handle or lever operated electrical switching devices can be controlled by a remote operator according to the present invention.

Exterior clips 24 on opposite sides of a mounting adaptor 25 attached to the circuit breaker 10 nest into notches 22 on opposite sides of the plastic housing 20 of the remote operator 12, thereby attaching the remote operator to the circuit breaker. The control handle 16 of the circuit breaker 10 extends into an opening 28 at one end of the remote operator housing 20. The opposite end of remote operator 12 extends partially through an opening in the electrical panel 14 and is attached thereto by a machine screw 26.

The remote operator housing 20 defines an internal cavity 30 in which the operational components are located and the cavity has surfaces with apertures, grooves and projections to support those components. Within that cavity 30 is a handle lever 34 with a first slot 36 at one end that receives a tie member in the form of a pin 38 connected to the control handle 16 of the circuit breaker 10. A second 42 slot is located at the other end of the handle lever 34 and a trunnion 40 between the two slots pivotally holds the handle lever within the operator housing 20. An operator handle 44 also is pivotally connected to the operator housing 20 with a portion extending through the opening in the electrical panel 14. An internal portion of the operator handle 44 has a pin 46 that is received in the second slot 42 of the handle lever 34.

A transmission 50 is located with in the cavity 30 of remote operator housing 20 and includes a bidirectional DC electric motor 32 with an output shaft onto which a first gear 51 is attached. A second gear 52, on a shaft 53, meshes with the first gear 51. A first bevel gear 54 also is attached to the shaft 53 and meshes with a second bevel gear 56 mounted on a threaded drive shaft 58 which extends across the housing 20. As a result of this mechanical coupling, energizing the DC electric motor 32 rotates threaded drive shaft 58 either clockwise or counterclockwise depending upon the polarity of the DC electricity applied to the motor 32.

Referring still to FIG. 1, a driver 60 is threaded onto the threaded drive shaft 58 and slides across the housing as the threaded shaft rotates. The driver 60 has a leg 62 extending from a driver body toward the circuit breaker 10 and a handle actuator 64 is slideably mounted on the leg. For example, the leg 62 is received in an aperture in the handle actuator 64. A spring 66 biases the handle actuator 64 along the leg outwardly from the driver 60. The assembly is illustrated in the "on" position in which the spring 66 biases the handle actuator 64 against a rail surface 68 of the operator housing 20 along which the handle actuator slides with driver 60. The handle actuator 64 has a post 65 which pushes against the circuit breaker control handle 16, as will be described.

The driver 60 also has a tab 70 on a side opposite to leg 62. In the "on" position illustrated in FIG. 1, the tab 70 abuts a first stop 72 on a switch operator 74 that slides laterally within grooves in the interior surface of the operator housing 20. The switch actuator 74 includes a bar 76 for engaging arms 75 of two switches in a switch assembly 78 which produces a signal that indicates the operational state of remote operator 12. With additional reference to FIG. 7, the switch assembly 78 comprises two single-pole, double-throw switches 77 and 79 mounted one behind the other which have separate arms 75 that are operated simultaneously by the switch actuator 74. The switches 77 and 79 are connected to the motor 32 and to a center-off, single-pole, double-throw switch 81, which is located outside the remote operator 12 and manually operated by a user. The electrical connection of these components allows the user to operate the remote operator in only one direction from each extreme travel position of the handle actuator 64 and prevents the motor 32 from burning out by attempting to drive the handle actuator beyond an extreme position, as will be described.

A person is able to manually operate the circuit breaker 10 by pressing the portion of the operator handle 44 that is exposed through the electrical panel 14. That force causes the operator handle 44 to rotate which pivots the handle lever 34 about trunnion 40. The pivoting motion of the handle lever 34 is transferred to the circuit breaker control handle 16 which in turn rotates thereby changing "on" and "off" state of the circuit breaker 10. Manual movement of the circuit breaker control handle 16 from the illustrated "on" position is away from the handle actuator 64. Because the transmission 50 engages the mechanical handle linkage by abutment of handle actuator post 65 with circuit breaker control handle 16, the transmission does not restrict manual operation of the circuit breaker 10. Similarly, when the circuit breaker 10 trips due to a current overload condition, its control handle 16 is able to move freely of the transmission 50. It should be noted that the tripped orientation of the circuit breaker control handle 16 is reflected in a similar orientation of the actuator handle 44. In fact, the actuator handle 44 appears to the user as the handle of a circuit breaker and the user is not aware of the interposed remote operator 12.

When the motor 32 is energized by a remotely located control circuit (not shown), the threaded drive shaft 58 is driven about its longitudinal axis in either the clockwise or counterclockwise direction depending upon the polarity of the DC electricity applied to the motor by the control circuit. For example, from the "on" position illustrated in FIG. 1, the circuit breaker 10 is moved to the "off" position by energizing the motor 32 so that the threaded drive shaft 58 moves the driver 60 and handle actuator 64 to the right in the drawing. Eventually the post 65 on the handle actuator 64 will strike the control handle 16 of the circuit breaker. Thereafter, continued movement of the driver 60 and handle actuator 64 causes the circuit breaker control handle 16 to rotate clockwise in the drawing. The rotational force is transferred from the circuit breaker control handle 16 to the handle lever 34 causing the latter element to rotate in the counter clockwise direction. The handle lever 34 in turn applies force to the operator handle 44 producing clockwise rotation of that handle.

Figure 2:
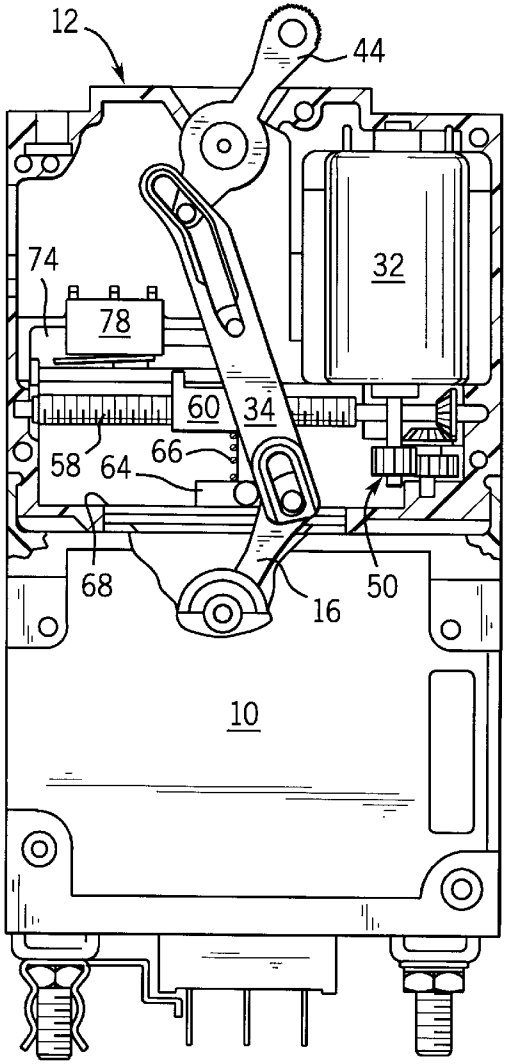
FIG. 2 is view similar to FIG. 1 with the remote operator in a first intermediate position.

Continued activation of the motor 32 moves the circuit breaker 10 into the "off" position at which point the remote operator 12 reaches a first intermediate position shown in FIG. 2. Note that in this state the switch actuator 74 is still engaging the arms 75 of switch assembly 78 thereby maintaining switches 77 and 79 in the same state as in FIG. 1 in which the circuit breaker 10 is in the "on" position. Because the switch has not changed states, the control circuit continues to apply electricity to the motor 32.

Figure 3:
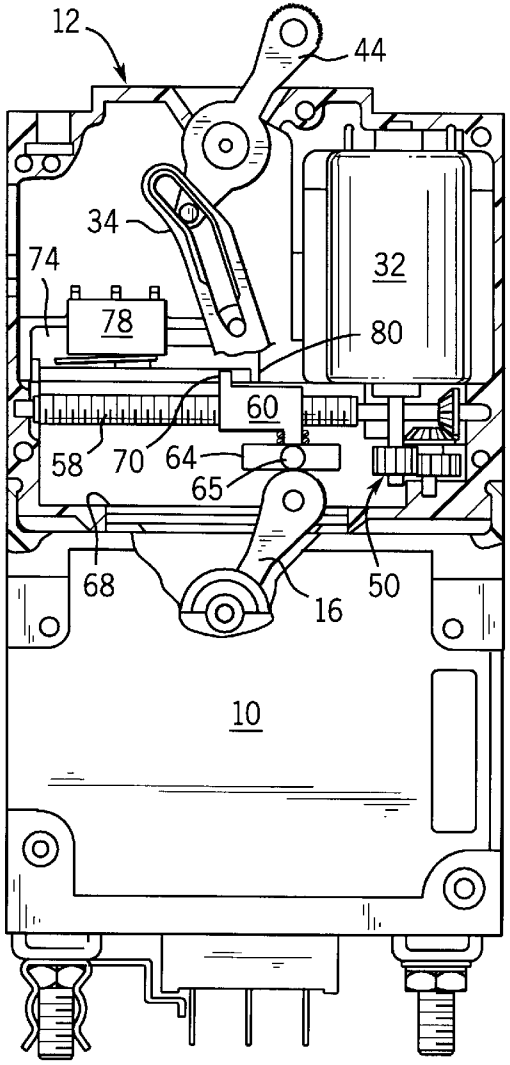
FIG. 3 is view similar to FIG. 1 with the remote operator in a second intermediate position.

Therefore, the transmission 50 continues to move the handle actuator 64 to the left in the drawing. However because the circuit breaker control handle 16 is at its extreme clockwise position and further movement of that handle is not possible, the post 65 on the handle actuator 64 begins riding up onto the curved end of the circuit breaker control handle 16. This causes the handle actuator 64 to slide upward along the driver leg 62 against the force of spring 66. The surface of the circuit breaker control handle 16 is designed to present an incline to the post 65 of the handle actuator 64 to aid in this sliding action. Eventually the handle actuator 64 reaches a second intermediate position at the top of the circuit breaker control handle 16 as illustrated in FIG. 3. Even in this position, the switch actuator 74 still engages the arms 75 of switch assembly 78 and maintains the switches 77 and 79 in the same state as in FIG. 1.

Figure 4:
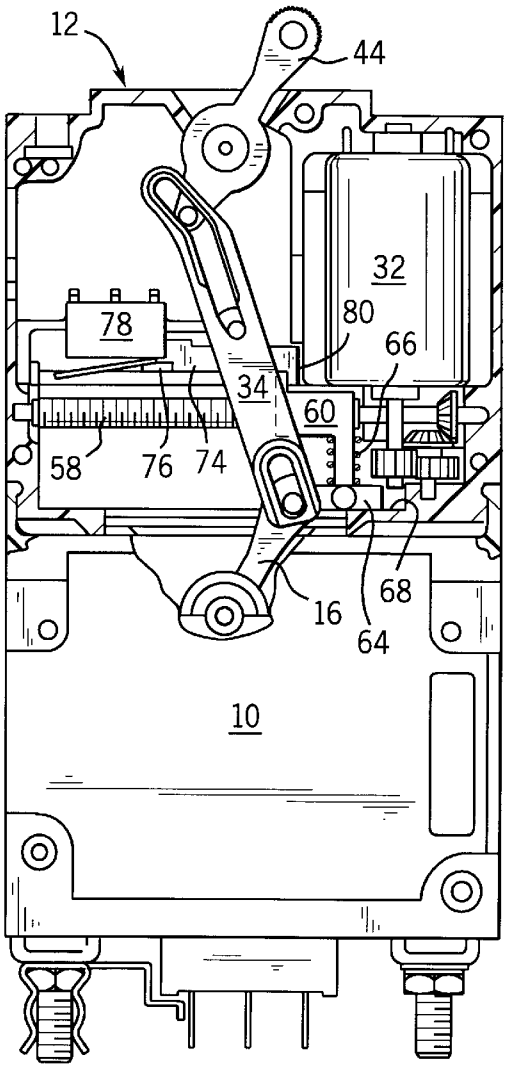
FIG. 4 is view similar to FIG. 1 with the circuit breaker and the remote operator in the "off" position.
Figure 7:
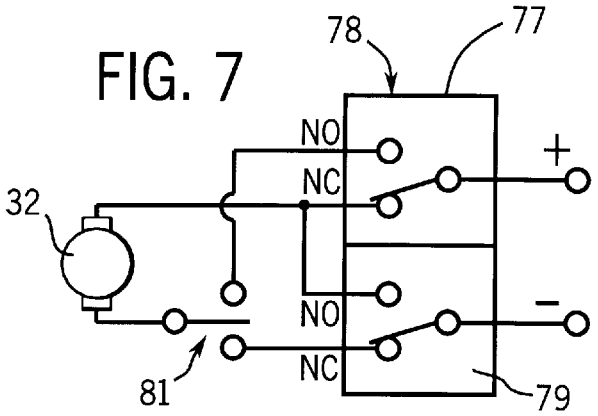
FIG. 7 is a schematic diagram of the remote control circuit for operating both embodiments of the remote operator.

Referring still to FIG. 3, continued activation of the transmission 50 results in the handle actuator post 65 sliding down the right side of the curved end of the circuit breaker control handle 16. During this stage of movement, the tab 70 on the driver 60 strikes a second stop 80 on the switch actuator 74 pulling that latter component to the right along with the driver. Ultimately the transmission 50 reaches the end of its rightward travel as shown in FIG. 4 at which point the switch actuator 74 has slid to a position where the switch arms 75 is released which results in the switches 77 and 79 in assembly 78 changing states. With reference to FIG. 7, the change in switches 77 and 79 de-energizes the motor 32 and terminates movement of the transmission 50. Thus the switch assembly 78 prevents the user's continued operation of manual switch 81 from applying power to the motor in a manner which would force the driver 60 against elements at the extreme ends of travel along the threaded drive shaft 58.

This activation of the remote operator 12 causes the circuit breaker 10 to move from the "on" position to the "off" position. At the end of movement of the circuit breaker control handle 16, the handle actuator 64 of the remote operator 12 travels over the circuit breaker handle to the opposite side of handle lever 34 and into a position at which the handle actuator will not interfere with manual operation of the circuit breaker 10. Specifically should a person push on the remote operator handle 44 to manually move the circuit breaker back to the "on" position that motion will be transferred via the handle lever 34 to the control handle 16. Thus the control handle 16 will be rotated in a direction away from the handle actuator 64. However the transmission 50 remains in the "off" position. Another switch (not shown) could be operated by the handle 44 or handle lever 34 of the remote operator 12 to provide a signal to the control circuit that indicates the state of the manual operating mechanism.

The remote operator can be energized to move the circuit breaker 10 into the "on" position, from the "off" position depicted in FIG. 4. This is accomplished by applying DC electricity of the opposite polarity to that used to move the circuit breaker to the "off" position. This causes motor 32 to rotate the threaded shaft in the opposite direction thereby moving the handle actuator 64 to the left in the drawing. When the circuit breaker control handle 16 reaches the "on" position, the handle actuator 64 rides over the handle into the position shown in FIG. 1 where the handle actuator will not interfere with either manual operation or tripping of the circuit breaker 10. Near the end of this leftward travel, the driver 60 strikes the first stop 72 on the switch actuator 74 pushing that latter component to the right as the driver 60 moves. At the end of leftward travel, the switch actuator 74 pushes arms 75 upward causing the switches 77 and 79 in assembly 78 to change states which de-energizes the motor 32.

Figure 5:
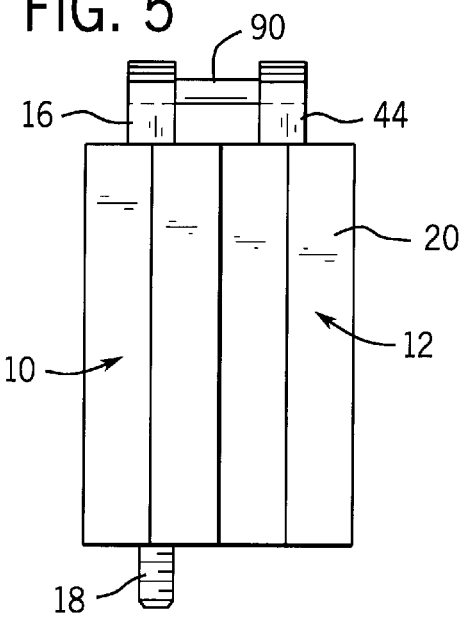
FIG. 5 shows an alternate embodiment in which the remote operator is attached to one lateral side of the circuit breaker.
Figure 6:
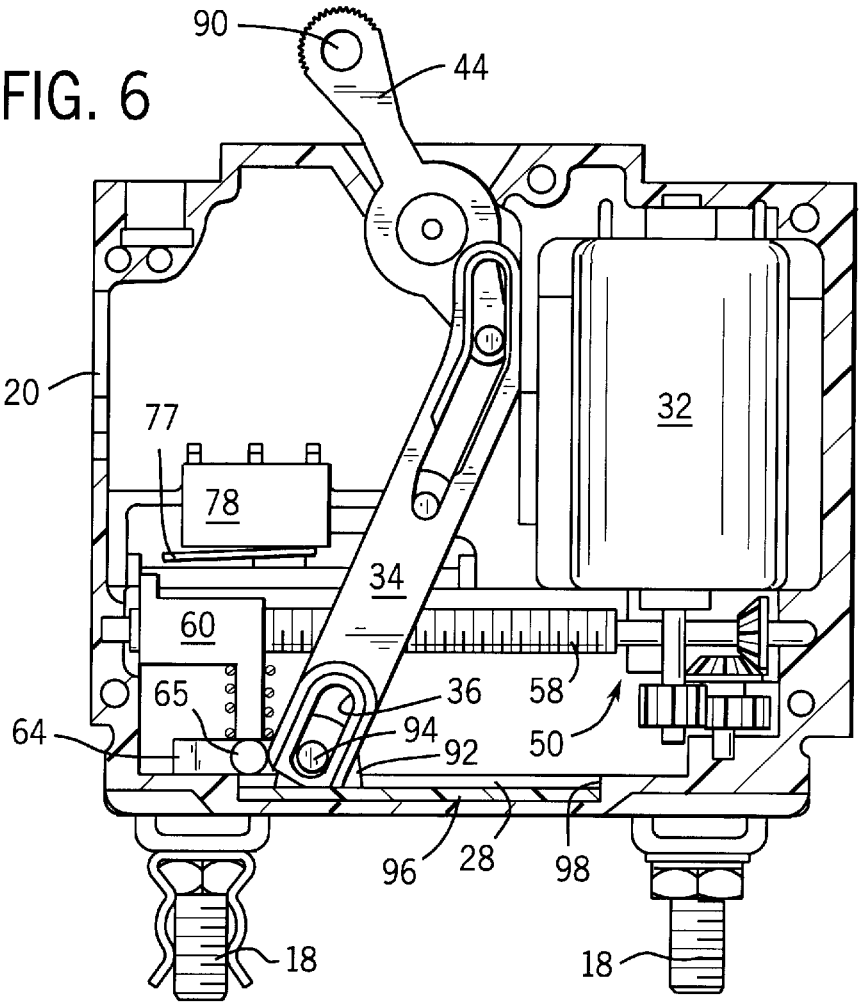
FIG. 6 is a view of the interior of the remote operator in FIG. 5 when the circuit breaker is in the "on" position.

Alternatively the remote operator 12 may be attached to one lateral side of the circuit breaker 10 as illustrated in FIGS. 5 and 6 with identical components being identified with like numerals as used in the preceding figures. In this mounting, the control handle 16 of the circuit breaker 10 is connected by a tie member 90 to the handle 44 of the remote operator 12. The handle 44 is linked within the remote operator 12 to one end of the handle lever 34. In this embodiment, the other end of the handle lever 34 does not engage the control lever 16 of the circuit breaker 12, but instead engages a handle simulator 92. The handle simulator 92 resembles the curved end of a circuit breaker control handle 12 and has a pin 94 that is received within the first slot 36 of the handle lever 34. A plate of insulating material closes the opening 28 in the remote operator housing 20.

As shown in FIG. 6, the motor 32 driving the threaded shaft 58 produces lateral movement of the driver 60 and the handle actuator 64. However the handle actuator 64 now engages the handle simulator 92 causing that latter element to slide across the interior of remote operator 12. The force exerted by the post 65 of the handle actuator 64 on the handle simulator 92 is transferred via the handle lever 34, operator handle 44 and pin 90 to the control handle 16 of the circuit breaker 10. This action causes the operator and control handles 44 and 16 to move in unison changing the state of the circuit breaker 10.

The continued activation of the motor 32 causes the handle actuator 64 to move the handle simulator 92 across the opening 28 in the remote operator housing 20. This movement terminates when the handle simulator 92 contacts the end wall 98 of the opening in which position the handle simulator replicates the "off" position of the circuit breaker control handle 16 in the embodiment in FIGS. 1–4. Further motion of the driver 60 to the right in the drawing causes the handle actuator 64 to ride up and over the curved surface of the handle simulator 92 in the same manner that it rode over the circuit breaker handle 16 in the previous embodiment. Thus the handle actuator 64 travels around the handle simulator 92 and handle lever 34 into a position at which the handle actuator will not interfere with manual operation of the circuit breaker 10. If a person pushes on either the circuit breaker handle 16 or the remote operator handle 44 to manually move the circuit breaker back to the "on" position, that motion when transferred to the handle lever 34 will not be restricted with by handle actuator 64. In fact, the handle lever 34 and handle simulator 92 move away from the final position of handle actuator 64.

The reverse action occurs when transmission 50 drives the circuit breaker 12 from the "off" to the "on" position.

What is claimed is:

1. A remotely controllable operator for a circuit breaker having a control handle moveable between two positions, said remotely controllable operator comprising:

a remote operator housing for mounting adjacent the circuit breaker;

an operator handle pivotally mounted to the remote operator housing and accessible for manual operation by a person;

a handle lever coupled to the operator handle;

a tie member for coupling one of the operator handle and the handle lever to the control handle, wherein movement of one of the control handle and the operator handle produces movement of the other of the control handle and the operator handle;

an electrically powered actuator attached to said remote operator housing and;

a handle actuator driven by the electrically powered actuator for exerting force on the handle lever which results in movement of the operator handle and for exerting force which moves the control handle between the two positions, wherein upon moving the control handle into one of the two positions the handle actuator moves from one side of the handle lever to another side.

2. The remotely controllable operator as recited in claim 1 wherein said electrically powered actuator comprises an electric motor.

3. The remotely controllable operator as recited in claim 2 wherein said electrically powered actuator further comprises a threaded shaft coupled to the electric motor and to the handle actuator.

4. The remotely controllable operator as recited in claim 3 wherein the threaded shaft is coupled to the electric motor by a plurality of gears.

5. The remotely controllable operator as recited in claim 1 further comprising a driver connected to the electrically powered actuator for reciprocal sliding movement in said remote operator housing and coupled to the handle actuator, wherein the handle actuator engages the control handle to effect movement thereof between the two positions.

6. The remotely controllable operator as recited in claim 1 further comprising:

a driver connected to the electrically powered actuator for reciprocal sliding movement in said remote operator housing and coupled to the handle actuator; and a handle simulator slideably mounted in the remote operator housing and coupled to the handle lever;

wherein the handle actuator engages the handle simulator to effect movement of the handle lever.

7. The remotely controllable operator as recited in claim 1 further comprising:

a switch assembly with a plurality of conductive states; and a switch actuator movably received in the remote operator housing and coupled to the handle actuator to change the conductive state of the switch assembly and thereby indicate a position of the handle actuator.

8. A remotely controllable operator for circuit breaker having an enclosure from which extends a control handle moveable between two positions, said remotely controllable operator comprising:

a remote operator housing;

an electrically powered actuator attached to said remote operator housing;

a driver connected to the electrically powered actuator for reciprocal sliding movement in said remote operator housing;

a handle actuator connected to the driver and engaging the control handle to effect movement thereof between the two positions, wherein upon moving the control handle into one of the two positions the handle actuator moves from one side of the control handle to another side;

an operator handle pivotally mounted to the remote operator housing and accessible for manual operation by a person; and a mechanical linkage coupling the operator handle to the control handle wherein movement of one of the control handle and the operator handle produces movement of the other one.

9. The remotely controllable operator as recited in claim 8 wherein said electrically powered actuator comprises:

a motor having an output shaft; and a threaded shaft coupled to the output shaft and to the driver.

10. The remotely controllable operator as recited in claim 9 wherein the threaded shaft is coupled to the output shaft by a plurality of gears.

11. The remotely controllable operator as recited in claim 8 wherein the handle actuator is moveable with respect to the driver.

12. The remotely controllable operator as recited in claim 8 wherein the driver has a body with a leg extending therefrom, and the handle actuator is slidably located on the leg; and further comprising a spring which biases the handle actuator with respect to the body.

13. The remotely controllable operator as recited in claim 8 further comprising:

a switch assembly with two conductive states; and a switch actuator movably received in the housing and coupled to the driver to change the conductive state of the switch assembly and thereby indicate a position of the handle actuator.

14. A remotely controllable operator for a circuit breaker having a control handle moveable between two positions, the remotely controllable operator comprising:

a remote operator housing for mounting adjacent the circuit breaker;

an operator handle pivotally mounted to the remote operator housing and accessible for manual operation by a person;

a tie member for connecting the operator handle to the control handle wherein movement of one of the control handle and the operator handle produces movement of the other one;

a handle lever coupled to the operator handle;

a handle simulator slideably mounted in the remote operator housing and coupled to the handle lever;

an electrically powered actuator attached to the remote operator housing;

a driver connected to the electrically powered actuator for reciprocal sliding movement in said remote operator housing; and a handle actuator engaging the driver and the handle simulator to effect movement of the operator handle to drive the control handle between the two positions, wherein upon moving the control handle into one of the two positions the handle actuator delects around the handle simulator.

15. The remotely controllable operator as recited in claim 14 wherein said electrically powered actuator comprises:

a motor having an output shaft; and a threaded shaft coupled to the output shaft and to the driver.

16. The remotely controllable operator as recited in claim 15 wherein the threaded shaft is coupled to the output shaft by a plurality of gears.

17. The remotely controllable operator as recited in claim 14 wherein the driver has a body with a leg extending therefrom, and the handle actuator is slidably located on the leg; and further comprising a spring which biases the handle actuator with respect to the body.

18. The remotely controllable operator as recited in claim 14 further comprising:

a switch assembly with a plurality of conductive states; and a switch actuator movably received in the remote operator housing and coupled to the driver to change the conductive state of the switch assembly and thereby indicate a position of the handle actuator.

19. The remotely controllable operator as recited in claim 1 wherein upon moving the control handle into one of the two positions the handle actuator moves over a surface of the control handle from one side of the control handle to another side.

20. The remotely controllable operator as recited in claim 8 wherein the mechanical linkage comprises a handle lever pivotally coupled to the housing and coupling the control handle to the operator handle.

* * * * *